United States Patent [19]

Anderson

[11] 4,041,621

[45] Aug. 16, 1977

[54] SNOWSHOE AND METHOD OF FABRICATING SAME

[76] Inventor: Richard Marlow Anderson, P.O. Box 211, Black Diamond, Wash. 98010

[21] Appl. No.: 524,235

[22] Filed: Nov. 15, 1974

[51] Int. Cl.[2] ..... A43B 5/04; A43D 9/00

[52] U.S. Cl. ..... 36/122; 12/142 R

[58] Field of Search ..... 36/2.5 R, 2.5 AB, 122, 36/123, 124, 125; 12/142 R

[56] References Cited

U.S. PATENT DOCUMENTS

| | | | |
|---|---|---|---|
| 1,038,264 | 9/1912 | Baker | 36/122 |
| 3,555,708 | 1/1971 | Goupil | 36/2.5 AB |
| 3,599,352 | 8/1971 | Novak et al. | 36/2.5 AB |
| 3,636,643 | 1/1972 | Lundquist | 36/2.5 AB |

FOREIGN PATENT DOCUMENTS

| | | | |
|---|---|---|---|
| 149,459 | 3/1955 | Switzerland | 36/123 |

*Primary Examiner*—Patrick D. Lawson

[57] ABSTRACT

A lightweight snowshoe having an outer frame formed of two sections of material such as metal tubing fastened together by joiner pieces which are held stationary with respect to the frame through use of a transverse support rod positioned within holes extending through the frame and the joiner sections. The joiner sections further act to strengthen the snowshoe frame at its principal stress points in the foot mounting area. The entire snowshoe is fabricated without the use of welds, glue or rivets, the pieces of the snowshoe frame being held together under the tension of the snowshoe webbing.

10 Claims, 3 Drawing Figures

SNOWSHOE AND METHOD OF FABRICATING SAME

BRIEF SUMMARY OF THE INVENTION

The present invention relates to snowshoes and more particularly to snowshoes whose primary structural members consist of metal pieces held in relation to each other by the webbing.

In snowshoes, it is desirable to keep weight to a minimum and yet provide sufficient structural strength to support the wearer. One method is to fabricate the snowshoe from light weight metal. Prior art has suffered from many disadvantages. For example, in order to provide adequate structural strength the snowshoe was made of thick sections of material which tend to reduce the saving in weight. In addition, if material thickness is reduced the members tend to fatigue when the snowshoe is used over irregular terrain, ultimately causing structural failure.

It is, therefore, the object of the present invention to provide a snowshoe of light weight yet having adequate structural strength.

It is another object of the present invention to provide a snowshoe which is durable and resistant to structural fatigue.

A still further object of the present invention is to provide a snowshoe which is low in cost.

Another object of the invention is to provide a snowshoe which is fabricated without the use of fasteners such as welds, screws or the like.

An additional object of the invention is to provide a snowshoe wherein the webbing acts to hold the structural members together.

BACKGROUND OF THE INVENTION

1. Field of the Invention

This invention relates, in general, to snowshoes, and in particular, to metal snowshoes formed from pieces which are slidably interconnected and held in relatively movable relation to each other by the snowshow webbing.

2. Description of the Prior Art

In the past, snowshoes have been primarily formed with bent wood frames covered with rawhide lace webbing. Snowshoes of this type are of necessity heavy and usually require treatment of the rawhide with shellac or the like in order to prevent wet snow from sticking thereto. Known metal snowshoe frames such as those shown in U.S. Pat. Nos. 892,053, 2,486,868 are fabricated using rivets, nuts and bolts, screws or welds and thus the pieces of the frame cannot move to any degree relative to each other, are relatively costly to manufacture and are liable to breakage of the welds or other connecting means which can have grave consequences for the user should it occur in the back country. U.S. Pat. No. 3,555,707 discloses a collapsible snowshoe wherein both of the metal cross braces are welded to the sides of the frame and the sides of the frames themselves are welded together at the tail of the shoe. U.S. Pat. No. 3,555,708 discloses a snowshoe having an outside frame formed from a single metal tube rigidly tied together near its tail by crimping the abutting ends of the tube into a connecting pin therein to engage notches in the connecting pin. The transverse support pieces of the snowshoe are shown as preferably made of wood having tapered ends inserted into holes in the tubular frame. The rigid tying of the frame together at its tail holds the cross pieces firmly in the holes in the frame and thus the web itself does not function to hold the frame together, nor does the notched pin strengthen the snowshoe at the principal stress points of the frame adjacent the wearer's foot.

These and other objects, and the nature of the invention, will be apparent from the following description taken in conjunction with the accompanying drawings.

DETAILED DESCRIPTION OF THE INVENTION

Figure 1:
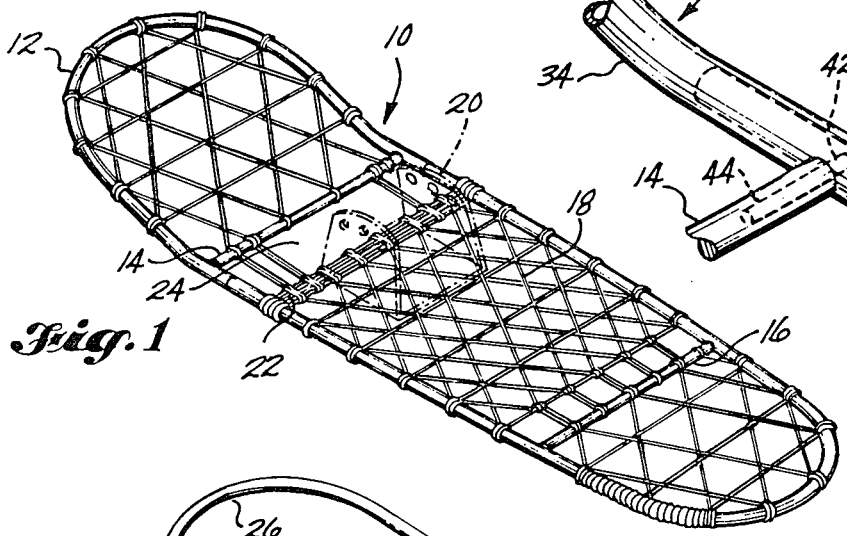
FIG. 1 is a perspective view of the typical snowshoe made according to the present invention including a binding shown thereon in dashed line.
Figure 3:
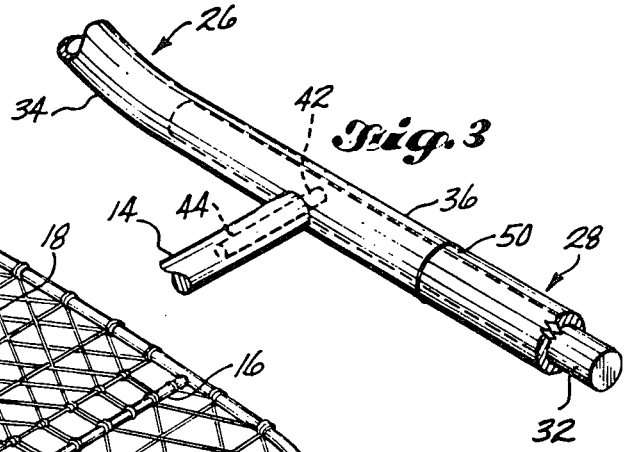
FIG. 3 is a partial perspective view of one of the joints whereby the toe piece 26 and the heel piece 28 are interconnected.
Figure 2:
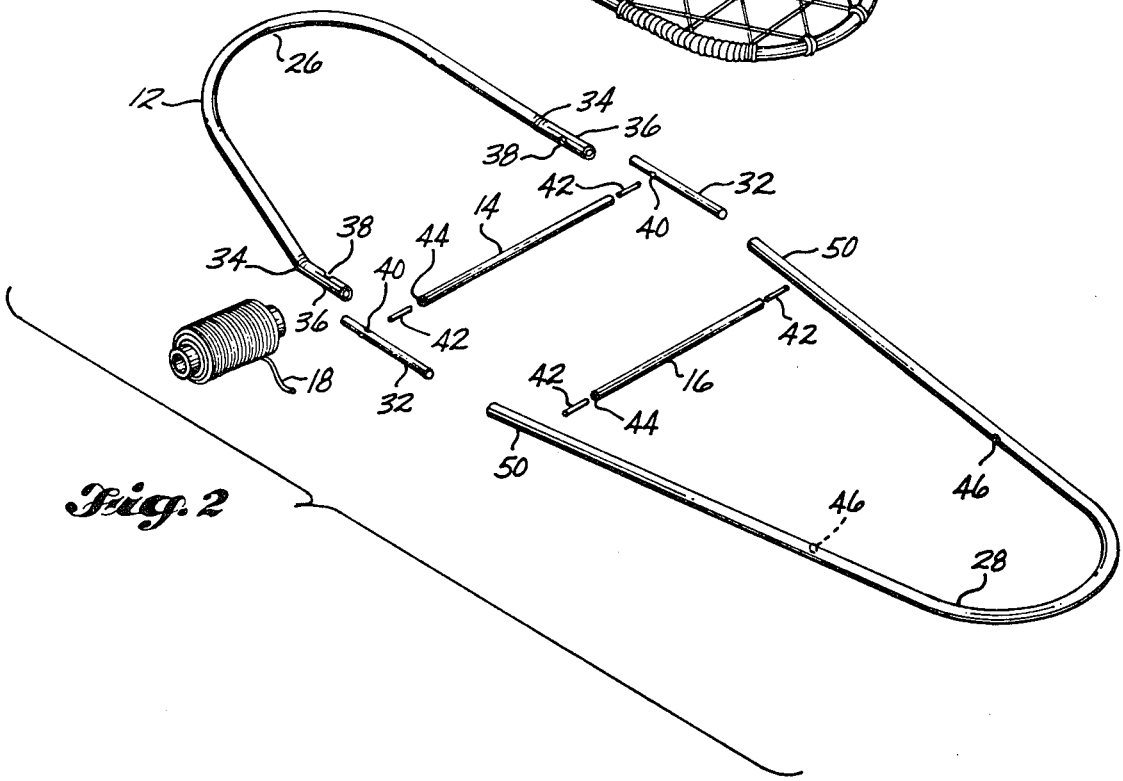
FIG. 2 is an exploded view of the snowshoe frame.

Referring to FIG. 2, it will be seen that the frame consists of a toe piece 26 and a heel piece 28, both formed of tubing, toe rod 14, heel rod 16, jointer pins 32 and rod pins 42.

When the snowshoe frame is caused to twist under loads applied by the wearer on irregular terrain the juctions of he toe piece 26 and the heel piece 28 are configured so as to permit the rotation of one with respect to the other thereby relieving torsional stresses at these points. The forgoing members are appropriately sized and configured to achieve snug fitting joints, such that when the webbing 18 is applied the members are held in place by the tension of the webbing and that the loads produced by the wearer will be appropriately distributed among the structural members.

The front portion of the toe piece 26 curves upwardly from the bends 34 while the straight ends 36 of the toe piece include the laterally spaced holes 38 drilled therein. The upward curve of the toe piece is of conventional design which is helpful to the wearer in staying on top of loose snow when walking.

It will be obvious to those skilled in the art that various changes may be made without departing from the spirit of the invention and therefore the invention is not limited to what is shown in the drawing and described in the specifications, but only as indicated in the appended claims.

What is claimed is:

1. A light, flexible snowshoe including a frame comprising a toe piece and a heel piece joined at points laterally adjacent the foot mounting position by jointer section means fixedly mounted on said toe piece and slidable with respect to said heel piece;

transverse support rod means slidably mounted within holes in said toe and heel pieces, the support rod means associated with said toe piece extending through a part of said jointer section means to fixedly hold said jointer section means with respect to the toe piece; and web means secured to and covering said frame to hold all said pieces in engagement with each other.

2. The snowshoe of claim 1 wherein said transverse support rod means each comprise a rod having longitudinal openings in each end, and a pair of pins mounted in said openings, said pins being formed of a material having greater resistance to bending and breaking than said rod itself.

3. The snow shoe of claim 1 wherein said toe piece is substantially U-shaped, the legs of said U-shaped toe piece being curved upwardly immediately forward of the mounting points of said associated transverse support rod means.

4. The snowshoe of claim 1 wherein said webbing is formed from polypropylene cord having a diameter of one-fourth inch.

5. The snowshoe of claim 1 wherein said jointer section means are sized to fit within the ends of said toe and heel pieces.

6. In a snowshoe of the type having an oval shaped tubular frame, two transverse support rods spaced longitudinally on said frame and a web woven over and secured to said frame, the improvement comprising:

a frame including a curved tow piece and a curved heel piece joined in abutting relation at laterally opposed points adjacent the longitudinally forwardmost transverse support rod;

jointer section means extending between the ends of said toe and heel pieces to hold said pieces in transverse alignment while allowing longitudinal movement therebetween;

pairs of laterally opposed holes disposed in each of said tow and heel pieces and a hole in each of said jointer sections alignable with the holes in said toe piece;

said transverse support rods mounted in said pairs of holes in said toe and heel pieces, said rod associated with said toe piece, extending through said holes in said toe piece and said holes in said jointer sections to hold said jointer sections stationary with respect to said toe piece; and, said web maintaining said transverse support rods, said jointer sections and said frame pieces in engagement with each other.

7. The snowshoe of claim 6 wherein said transverse support rods are movable with respect to said frame sections.

8. The snowshoe of claim 6 wherein said jointer section means are sized to fit within the ends of said toe and heel pieces.

9. The snowshoe of claim 6 wherein said holes in said jointer sections are alignable with holes in said heel piece.

10. A method of constructing a snowshoe of the type including an outer frame, transverse support rods and a covering web holding said frame and said transverse support rods together including the steps of:

bending two pieces of hollow tubing to form generaly U-shaped toe and heel frame pieces;

placing said U-shaped pieces in open-end abutting relationship;

inserting jointer sections within or over the ends of said hollow frame pieces;

drilling laterally opposed pairs of holes in said toe and heel pieces, one of said pairs of holes extending through said jointer sections;

mounting said transverse support rods in said drilled holes so that the ends of one of said rods extends into said jointer sections;

temporarily binding said frame pieces to hold said jointer sections and said transverse rods therein; and, weaving a permanent web over said frame and said transverse rods to fixedly hold said frame pieces, transverse rods and jointer pins adjacent each other.

* * * * *